US006319475B1

(12) United States Patent
Katoh et al.

(10) Patent No.: US 6,319,475 B1
(45) **Date of Patent: *Nov. 20, 2001**

(54) SAMPLE CONTAINER

(76) Inventors: Keiichi Katoh, 1634-1-305, Maginu, Miyamae-ku, Kawasaki City, Kanagawa Pref., 216; Syuzi Ueda, 3-21-406, Nagayama 3-Chome, Tama City, Tokyo 206, both of (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/875,124

(22) PCT Filed: Feb. 24, 1995

(86) PCT No.: PCT/JP95/00273

§ 371 Date: Aug. 11, 1997

§ 102(e) Date: Aug. 11, 1997

(87) PCT Pub. No.: WO96/26008

PCT Pub. Date: Aug. 29, 1996

(51) Int. Cl.[7] ..... B01L 3/00

(52) U.S. Cl. ..... 422/102; 422/99; 206/524.2; 206/524.3; 220/62.11; 220/62.15

(58) Field of Search ..... 422/99, 102, 104; 206/524.1, 524.3, 524.2; 220/62.11, 62.19, 62.12, 62.13, 62.15

(56) References Cited

U.S. PATENT DOCUMENTS

| | | | | |
|---|---|---|---|---|
| 4,072,243 | * | 2/1978 | Conant et al. | 215/12 R |
| 4,743,544 | * | 5/1988 | Namba et al. | 435/7 |
| 4,744,478 | * | 5/1988 | Hahn | 215/252 |
| 4,773,559 | * | 9/1988 | Sasaki et al. | 220/355 |
| 4,872,590 | * | 10/1989 | Sasaki et al. | 220/457 |
| 5,012,950 | * | 5/1991 | Knappe | 220/459 |
| 5,804,270 | * | 9/1998 | Kawamura et al. | 428/36.92 |

* cited by examiner

*Primary Examiner*—Jill Warden
*Assistant Examiner*—Dwayne K Handy
(74) *Attorney, Agent, or Firm*—Ostrager Chong & Flaherty LLP

(57) ABSTRACT

Conventional container is composed of a single resin layer. In case of applying heat externally to the container, the heat is hardly conducted. According to the present invention, a container with high thermal conductivity can be provided. A portion contacted with a sample is composed of a resin alone, a portion contacted with a sample container supporter is composed of two portions of a flexible resin mixed a filler having high thermal conductivity therein and a resin and a filler having high thermal conductivity. The present invention is applicable to biotechnological, chemical, medical and engineering fields to develop new uses and applications.

11 Claims, 6 Drawing Sheets

SAMPLE CONTAINER

FIELD OF THE INVENTION

The present invention relates to a container for containing sample in which a thermal process is needed to be applied used in a medical, chemical, and biotechnology fields.

BACKGROUND OF THE INVENTION

Conventional container is composed of a single thick resin layer. Because of this, the heat is hardly conducted while thermal process is applied externally to the container. The sample in the container cannot be heated and cooled effectively. In addition, flexibility in a part of an outer surface of the container which is contacted with a container supporter is out of consideration. Therefore, the container and the container supporter are contacted insufficiently, resulting in poor heat transfer coefficency therebetween.

An object of present invention is to effectively transmit a heating or a cooling from outside, to the sample, to which the thermal process is required to be applied, solving such conventional problem.

SUMMARY OF THE INVENTION

The present invention takes advantage of technical means for obtaining a good thermal conductivity by adding an inorganic substance which has 10W/(mK) or more of the thermal conductivity as a filler in a resin. In other words, a defect of the resin originally having a small thermal conductivity is compensated with the inorganic filler, which is dispersed in the resin, having a large thermal conductivity. If content ratio by volume of the inorganic filler is small, effect to improve the thermal conductivity is small. At least 30% by volume of the inorganic filler is required to be added. The more the amount of the inorganic filler is, the larger the thermal conductivity is. However, more than 90% by volume of the inorganic filler is hard to be realized. If an inorganic filler in a form of perfect spherical particles is, for example, up to 95% by volume of the inorganic filler is available. 30% to 95% by volume of the inorganic filler may be selected in view of strength, thermal conductivity, a cost, a shape or the like. Any shape of the inorganic filler may be selected from particles, whiskers, fibers, a foil or the like depending on purposes. A plurality of shapes may be combined, if required. Material of the inorganic filler may be selected from the group consisting of cermamics, metal and carbon having not less than 10W/(mk) of thermal conductivity, for example boron nitride, aluminum oxide, silicon carbide, silicon nitride, calcium carbonate, magnesium oxide, silicon oxide, quartz glass, zirconium oxide, titanium oxide, beryllium oxide carbon, diamond, gold, silver, copper, aluminum, tungsten and molybdenum or the like in view of strength, insulating ability or the like depending on purposes. These materials may be combined.

Some samples require no contact portion with the inorganic filler material in view of their properties, therefore the contact portion have to be a resin. The contact portion is formed with a suitable resin alone for the sample properties after selecting a kind of resin. Thickness of the contact portion formed with the resin alone is to be at least 5 $\mu$m, however it depends on the material thereof, because too thin contact portion may be broken to make the sample contact with the inorganic filler. On the other hand, if the thickness exceeds a predetermined level, heat resistance of the contact portion formed with the resin alone becomes large to inhibit transmitting the heat to the sample. 200 $\mu$m or less of the thickness is preferable. Namely, the container of the present invention is composed of two portions which are the portion contacting with the sample constituted with the resin alone and the rest portion constituted with a composite of the resin and the inorganic filler.

The resin used for the portion of the outer surface of the container which is contacted with the container supporter is softer than that used for the sample container, thereby the container supporter can be stuck fast to the outer surface of the container. In other word, the soft resin is deformed to stick fast to a concave-convex surface of a hole in the container supporter into which the container is inserted, whereby heat is effectively transmitted from the container supporter to the container. The mechanism of the soft resin deformation may be plastic deformation or elastic deformation. In case of the plastic deformation, tensile strength of the resin used for the portion of the outer surface of the container which is contacted with the container supporter is preferably 32 MPa or less. In case of the elastic deformation, longitudinal elastic modulus of the same is preferably 1.4 GPa or less. The soft resin may be a soft gel resin. In case that the sample is treated under a thermal process at a temperature in a range from 50° C. to 100° C., the resin used for the portion of the outer surface of the container which is contacted with the container supporter is deformable by the thermal process to be stuck tightly to the sample container, when the same resin has 50° C. of softening temperature. Temperature applied at the thermal process in a biotechnology field is substantially 100° C. or less. Therefore, the resin used for the portion of outer surface of the container which is contacted with the container supporter having 100° C. or less of the softening temperature may be selected depending on purposes. When this soft resin is used, the content ratio of the inorganic filler is preferably 30% to 95% by volume as well. 5 to 300 $\mu$m in thickness of the inorganic filler is effective.

According to th e sample container constructed as described above, because of provision of the composite portion composed of the resin and inorganic filler with high heat conductivity, it is possible to effectively transmit the heating and cooling process from the outside to the sample. Due to the fact that the sample does not directly touch the inorganic filler, there will be no damage to the sample. Furthermore, when the resin of the outer portion which is contacted with the sample container supporter is composed of softer material than that of the main resin of the sample container, close sticking between the sample container supporter and the sample container is possible.

BEST MODE OF THE PRESENT INVENTION

The following explains this invention in detail by using the attached figures.

Figure 1:
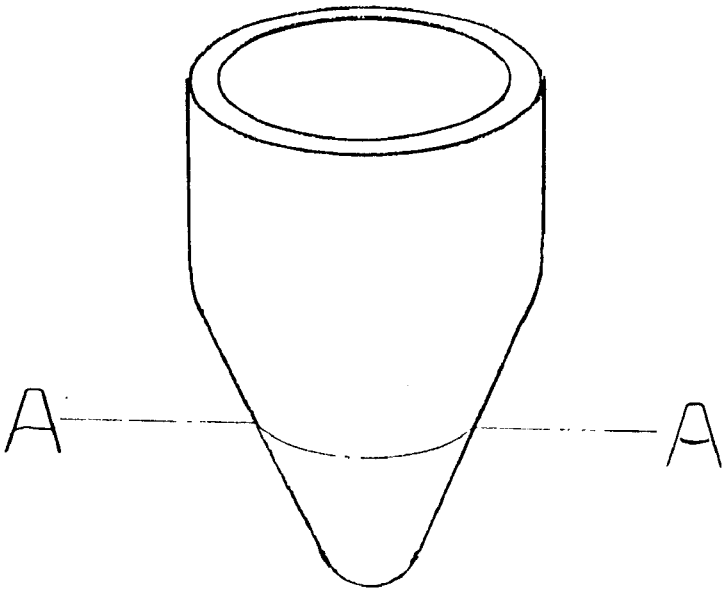
FIG. 1, FIG. 4 and FIG. 7 are of the outside configurations of the container in accordance with a preferred embodiment of this invention.
Figure 2:
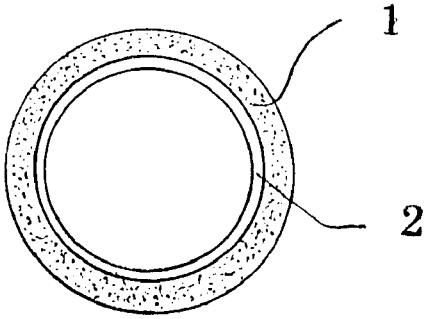
FIG. 2, FIG. 5, FIG. 8, FIG. 11, and FIG. 12 are of the cross section views of the container in accordance with a preferred embodiment of this invention.
Figure 3:
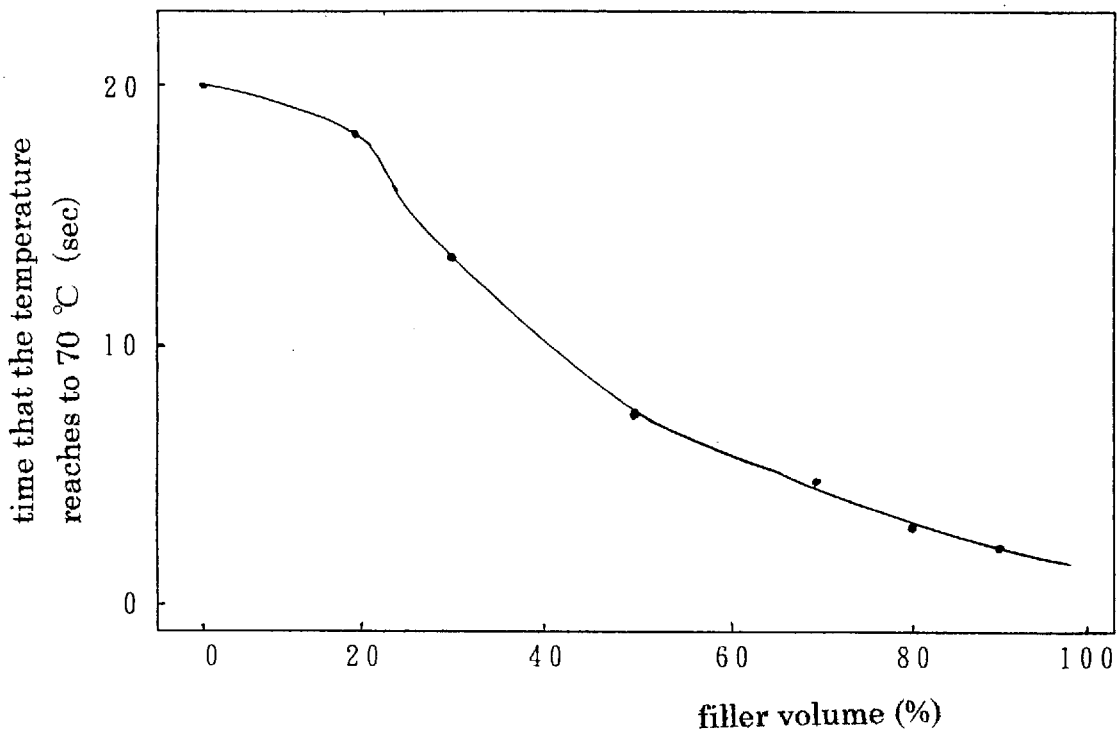
FIG. 3 indicates the relationship between the disposed amount of the filler and its heat conductivity.
Figure 11:
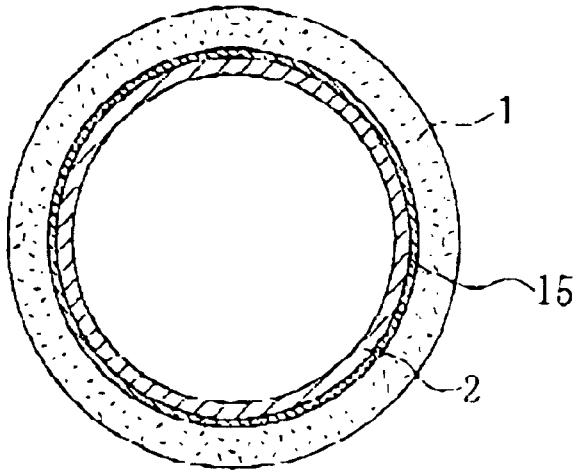

FIG. 1 illustrates the outside configuration of the preferred container according to the present invention. FIG. 2 shows a sectional view taken along the line A—A in FIG. 1. As FIG. 2 in cross section shows this sample container of two layers includes high heat conductive composite portion 1 consisting of the filler made of a powdered silicon carbide and polypropylene resin, and pure polypropylene resin portion to prevent the sample from direct contacting with the filler. The process for manufacturing this sample container is two multi-layer blow moldings. The high heat conductive composite portion 1 is made of the filler with the mixed volume ratio of 0%, 20%, 30%, 50%, 70%, 80%, 90% of silicon carbide powder and has thickness of 1 $\mu$m meters to 20 $\mu$m; and portion 2 is made of polypropylene resin only and has thickness of 30 $\mu$m. On each inside surface of the container, the thermocouple is pasted; and each container is placed in the fixed-temperature reservoir of 80° C. The sample container is placed in the same condition, meaning that it is also placed in the fixed temperature reservoir of 80° C.; and the time interval for the temperature to rise from the room temperature to 70° C. was measured. FIG. 3 shows the result. As shown in the figure, for less than 30% mixed volume ratio of the filler not in the scope of this invention, the heat conductivity of the high heat conductive composite portion is not sufficient. The higher the mixed volume ratio, the better the result. Yet such problems as deterioration of mechanical strength may occur with a high mixed volume ratio. Hence, considering the required hardness, usage condition of the container and so forth, one may freely choose the mixed volume ratio of filler from 30% to 95%. Despite the fact that silicon carbide powder is used for the inorganic filler in this example, one may freely choose from such forms as powder, whiskers, fibers and foils for the inorganic filler that has equal to or more than 10 Watt/mk. Moreover, although two layers are used in this example, one may use three layers, meaning that there is a stress absorbing layer 15 (FIG. 11) between the first and second layer. By installing this layer, it becomes possible to absorb severing stress between the first and second layers. Furthermore, as portion 2 which is contact with the sample inside is made of polypropylene, the same as portion 1 in this example. However, it is not limited to this material. Depending on the sample, the purpose of the applied heating process and mechanical strength of the container, one may use resin material of portion 1 or of portion 2. The manufacturing process for portion 2 should not be limited to two-colored blow molding. After molding the high heat conductive composite portion of the container, one may form the resin of portion 2 which is contact with the inside sample by coating.

Figure 4:
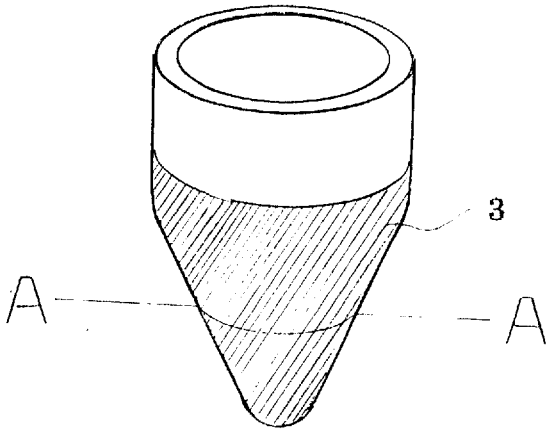
Figure 5:
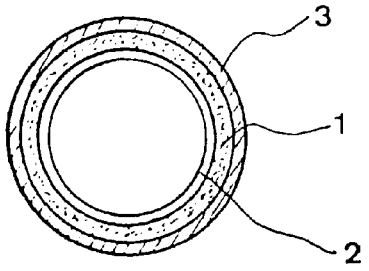
Figure 6:
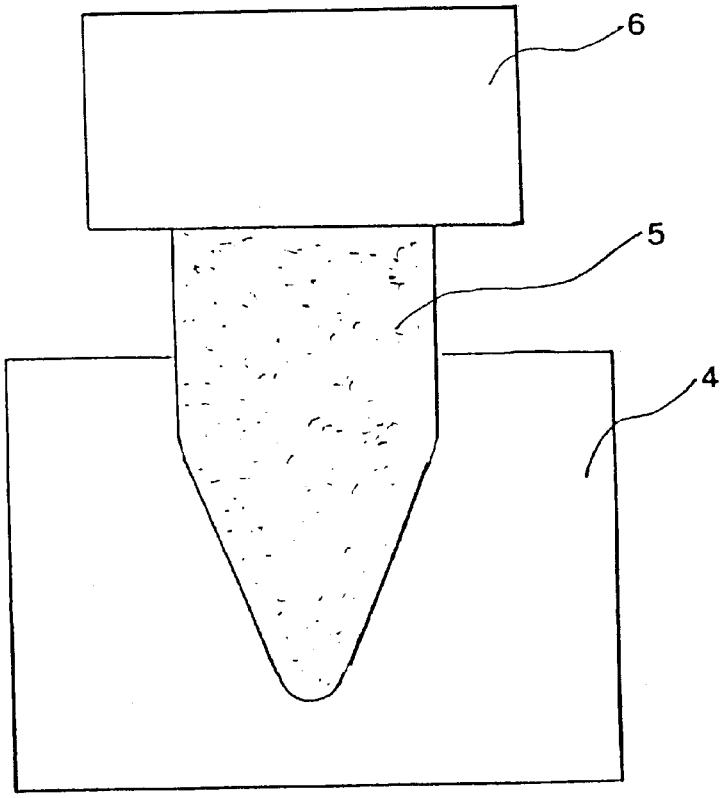
FIG. 6 and FIG. 10 describe the comparative test of containers.

For example, the copper powder having elasticity has been dispersed so that a layer of gel silicon resin is formed. The portion of the above-mentioned container which is contacted with the outside surface of the sample container supporter is treated to be gelled as indicated in FIG. 4. Portion 3 in FIG. 4 is the gel silicon resin layer to which the copper powdered having elasticity has been dispersed. FIG. 5 is a cross section taken along a line A—A of FIG. 4. The manufacturing process of this portion is: that the paste, which is made of the copper powder that is mixed with pre-gelled silicon resin, added with such chemical as surfactant and dispersant, stirred in order to be uniformly dispersed and mixed with the solvent to adjust its viscosity, is applied to the container with 70% mixed volume ration of silicon carbide filler as in the above example. This portion is treated to be gelled. In this example, gel treatment through heat is applied. After this process, the comparison test was conducted as FIG. 6 indicate: the test in which the container with the soft portion locating in the aluminum block 4 of dry fixed-temperature reservoir is compared with the one without it. The aluminum block is set at 80° C. and each container is inserted into each hole of the container supporter; and in order to stick them firmly, weights are placed upon the sample container. Then, as in the example 1, the time interval in which the temperature reaches 70° C. is measured. The results is that the one with soft portion has shortened 80% time interval as compared with the one without it. The soft portion is formed by applying the paste in this example, but the method is not limited to this procedure. For instance, this process may take place at the time of molding. Namely, three-color molding by an injection may be conducted. Material of the soft portion may be selected from the range of the present invention. The resin used for the portion of the outer surface of the sample container supporter may be selected from the resin having 32 MPa or less of tensile strength, 1.4 GPa or less of longitudinal elastic modulus or 100° C. or less of the softening temperature depending on purposes. In addition, a relaxing layer between the composite 1 with high thermal conductivity and the soft portion 3 may be formed. The relaxing layer can release a shearing stress between the layer 2 and 3. The inorganic filler dispersed in the soft portion 3 is not limited to the copper particles. Any inorganic filler with not less than 10 W/(mK) of thermal conductivity and any shape such as particles, whiskers, fibers and a foil of the inorganic filler may be selected depending on purposes.

Figure 7:
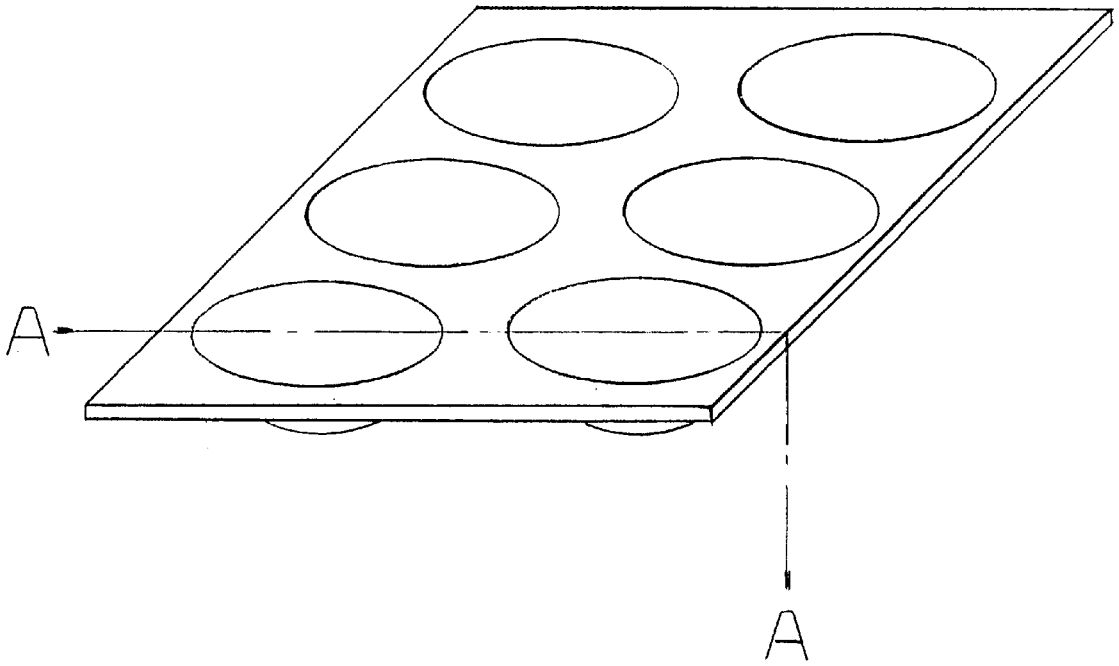
Figure 8:
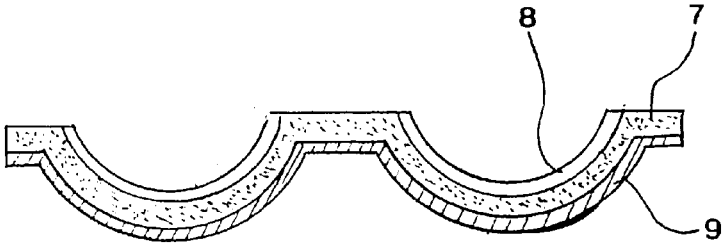
Figure 9:
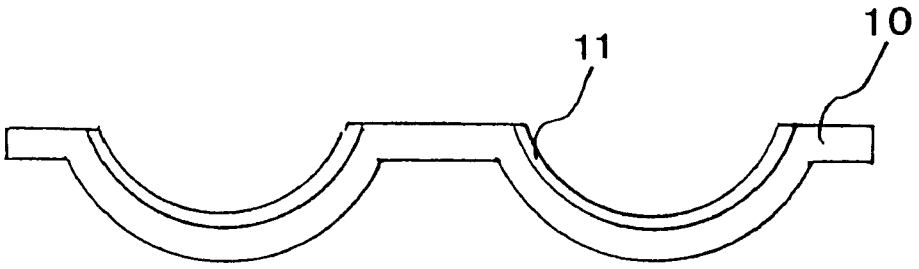
FIG. 9 is an example of the comparison.
Figure 10:
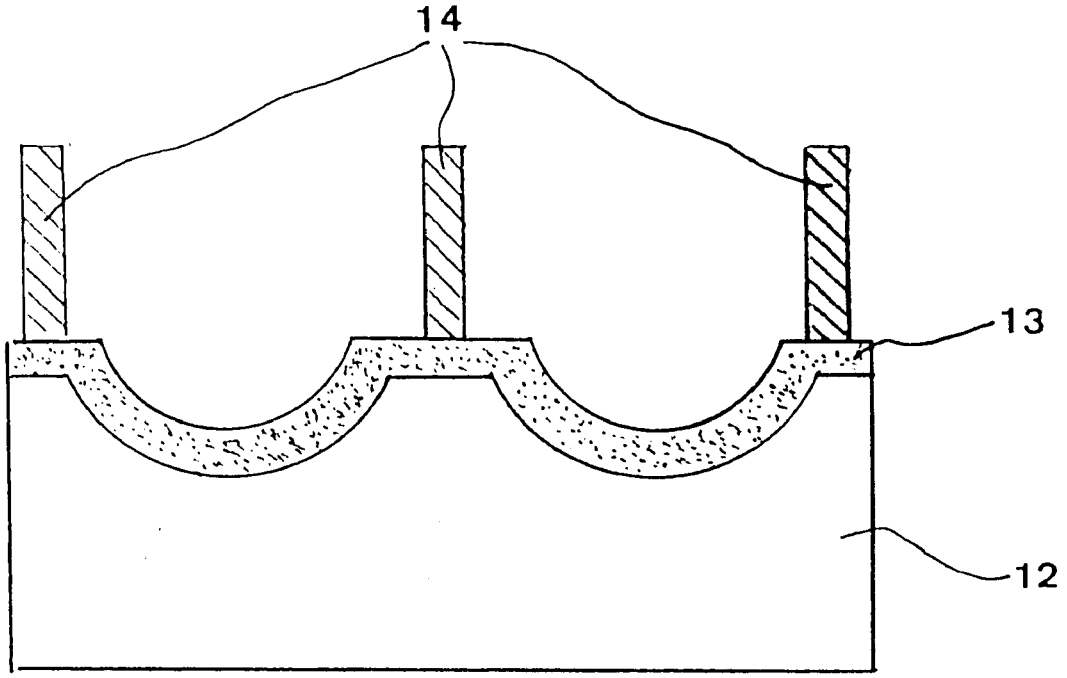

FIG. 7 shows another embodiment of the container in accordance with the present invention. FIG. 8 is a sectional view taken along line A—A of FIG. 7. Portion 7 represents an epoxy resin added 60% by volume of boron nitride particles as the inorganic filler. Portion 8 represents polypropylene. Portion 9 represents soft polyvinyl chloride (PVC) with dispersed boron nitride particles. Same test as the embodiment 2 was performed. Comparative container composed of an epoxy resin portion 10 added no inorganic filler and polypropylene portion 11 as shown in FIG. 9 was prepared. The respective containers 13 were set to an aluminum block 12 as shown in FIG. 10 and were pressed down using rods 14. Thermocouples were adhered to bottom surface 15 of this sample container and the comparative embodiment to perform the test. As a result, the time reached 70° C. of this embodiment was one seventh of that of the comparative embodiment. This embodiment thus showed an excellent result.

The present invention has been described in the embodiments, but is not limited thereto. It is therefore to be understood that changes and modifications may be made without departing from the scope and spirit of the invention.

Industrial Applicability

As described above, the present invention relates to a container with high thermal conductivity capable of transmitting a thermal process such as heating or cooling which is externally applied to a sample promptly and effectively. The present invention is applicable to biotechnological, chemical, medical and engineering fields to develop new uses and applications.

What is claimed is:

1. A sample container which is to be heated and/or cooled by a thermal instrument having at least one well or recess for receiving the container, the container having one or more portions holding a sample and comprising three layers, a first layer or an inner layer which contacts the sample being made of a first resin inert to the sample, a second layer disposed at an outer side of the inner layer being made of a second resin incorporated with an inorganic filler of high heat conductivity, the inorganic filler being selected from the group consisting of ceramics, metals, and carbons having a thermal conductivity which is not less than 10 W/ (mK) and a third layer disposed at an outer side of the second layer which contacts the well or recess of the thermal instrument, said third layer being made of a third resin which is a softer resin than the first resin, and is sufficiently pliable to deform to the surface of the well or recess of the thermal instrument, such that heat transfer is conducted through direct contact between the outer surface of the container and the surface of the well or recess of the thermal instrument.

2. The container according to claim 1, wherein the third layer further comprises the inorganic filler.

3. The container according to claim 1, wherein the third resin is 5 $\mu$m to 300 $\mu$m thick.

4. The container according to claim 1, wherein the third resin has a tensile strength of not more than 32 MPa.

5. The container according to claim 1, wherein the third resin has a longitudinal elastic modulus of not more than 1.4 GPa.

6. The container according to claim 1, wherein the third resin is a gel.

7. The container according to claim 1, wherein the third resin has a softening temperature of not more than 100° C.

8. The container according to claim 1, wherein the second layer is comprised of 30% to 95% by volume of the inorganic filler.

9. The container according to claim 1, wherein the inorganic filler has at least one shape selected from the group consisting of particles, whiskers, fibers and foil.

10. The container according to claim 1, wherein the inorganic filler is comprised of at least one material selected from the group consisting of boron nitride, aluminum oxide, silicon carbide, silicon nitride, calcium carbonate, magnesium oxide, silicon oxide, quartz glass, zirconium oxide, titanium oxide, beryllium oxide, carbon, diamond, gold, silver, copper, aluminum, tungsten and molybdenum.

11. The container according to claim 1, wherein the first resin contacted with the sample is 5 $\mu$m to 200 $\mu$m thick.

* * * * *

UNITED STATES PATENT AND TRADEMARK OFFICE

CERTIFICATE OF CORRECTION

PATENT NO. : 6,319,475 B1
DATED : November 20, 2001
INVENTOR(S) : Katoh

It is certified that error appears in the above-identified patent and that said Letters Patent is hereby corrected as shown below:

Title page,
Item [57], ABSTRACT,
Beginning at line 1, replace entire ABSTRACT with:
-- A conventional sample container is formed out of a single resin. Therefore, when such a sample container is subjected to a temperature process, the efficiency is very low. The present invention provides a sample container of a high heat conductivity and a high heat transfer rate. The portion if this sample container, in contact with a sample, is formed out of a resin alone, the portion, in contact with the sample support, is made of a material of a mixture of a soft resin, and a filler of a high heat conductivity. The other portions are made of a resin and a filler of a high heat conductivity. The sample container is suitable used in the biotechnological field, the fields concerning chemistry, medicine and engineering, and other fields possible in future --.

Column 1,
Line 10, insert -- A -- before “conventional”.
Line 58, replace “have” with -- has --.
Line 63, insert -- a -- before “scouring”.
Line 63, replace “make” with -- allow --.
Line 63, insert -- to -- after “sample”.

Column 2,
Line 22, replace “case that” with -- cases where --.

Column 3,
Line 8, replace “directly” with -- direct --.
Line 13, omit “meters”.
Line 15, replace “the” with -- each --.
Line 15, replace “each” with -- the --.
Line 40, insert -- in -- between “is” and “contact”.
Line 40, insert -- , -- after “inside”.

UNITED STATES PATENT AND TRADEMARK OFFICE

CERTIFICATE OF CORRECTION

PATENT NO. : 6,319,475 B1
DATED : November 20, 2001
INVENTOR(S) : Katoh

Figure 12:
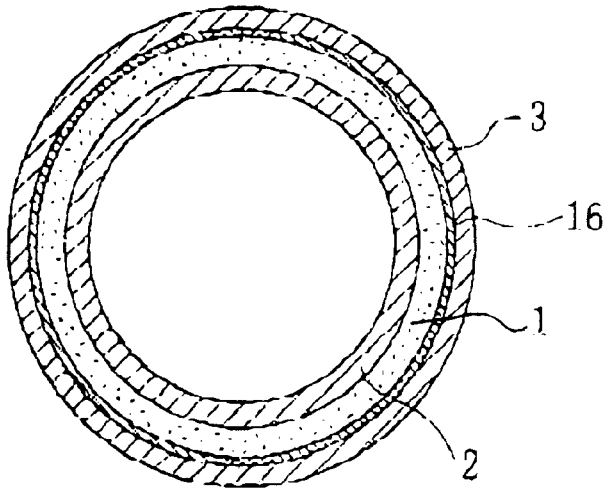

It is certified that error appears in the above-identified patent and that said Letters Patent is hereby corrected as shown below:

Column 4,
Line 2, replace “locating” with -- is located --.
Line 4, insert -- 4 -- after “block”.
Line 5, insert -- 5 -- after “container”.
Line 6, insert -- 6 -- after “weights”.
Line 22, insert -- 16 (Fig. 12) -- after “layer”.
Line 24, insert -- 16 -- after “layer”.
Line 44, insert -- in this embodiment -- after “result”.
Line 44, replace “reached” with -- to reach --.
Line 45, omit “of this embodiment”.
Line 61, insert -- subjected -- between “is” and “to”.

Signed and Sealed this

Twentieth Day of August, 2002

*Attest:*

*Attesting Officer*

JAMES E. ROGAN
*Director of the United States Patent and Trademark Office*